United States Patent [19]

Ashworth

[11] Patent Number: 4,560,391

[45] Date of Patent: Dec. 24, 1985

[54] ALTERNATIVE FUEL COMPRISED OF SEWAGE SLUDGE AND A LIQUID HYDROCARBON FUEL OIL

[75] Inventor: Robert A. Ashworth, Tampa, Fla.

[73] Assignee: Florida Progress Corporation, St. Petersburg, Fla.

[21] Appl. No.: 615,725

[22] Filed: May 31, 1984

[51] Int. Cl.[4] ..... C10L 1/32

[52] U.S. Cl. ..... 44/51; 44/1 D

[58] Field of Search ..... 44/51, 1 D

[56] References Cited

U.S. PATENT DOCUMENTS

| | | | |
|---|---|---|---|
| 3,559,596 | 2/1971 | Ishii | 110/7 |
| 4,026,223 | 5/1977 | Robbins | 110/7 |
| 4,145,188 | 3/1979 | Espenscheid et al. | 44/51 |
| 4,168,670 | 9/1979 | Wall et al. | 110/346 |
| 4,170,551 | 10/1979 | Honour | 210/27 |
| 4,405,332 | 9/1983 | Rodriquez | 44/51 |
| 4,440,543 | 4/1984 | Echtler | 44/51 |

FOREIGN PATENT DOCUMENTS

| | | | |
|---|---|---|---|
| 55-94996 | 7/1980 | Japan . | |
| 7704635 | 11/1977 | Netherlands | 44/51 |

*Primary Examiner*—Y. Harris-Smith

*Attorney, Agent, or Firm*—Russell, Georges, Breneman, Hellwege & Yee

[57] ABSTRACT

An improved fuel composition is provided comprising in minor proportion a non-dewatered sewage sludge and in major proportion an organic fuel comprised of a hydrocarbon fuel oil. A method is also provided for the incineration of sewage sludge comprised of providing an admixture of a minor proportion of a non-dewatered sewage sludge and a major proportion of an organic fuel comprised of a liquid hydrocarbon fuel oil and incinerating the admixture.

14 Claims, 4 Drawing Figures

ALTERNATIVE FUEL COMPRISED OF SEWAGE SLUDGE AND A LIQUID HYDROCARBON FUEL OIL

BACKGROUND OF THE INVENTION

The present invention is directed to a fuel composition comprised of sewage sludge and an organic fuel comprised of a liquid hydrocarbon fuel oil.

In an effort to provide an economic and environmentally acceptable method for the disposal of sewage sludge, various municipalities have recently begun to investigate various means to accomplish this difficult task. Disposal of sewage sludge is rapidly becoming a world-wide problem. Many large municipalities on ocean coastlines dump sewage sludge produced by them into the oceans with the consequence of ultimately endangering ocean aquatic life. Inland municipalities frequently employ the sludge as a source of plant nutrients. However, the supply of sewage sludge is rapidly exceeding demand. As a result, the sewage sludge is frequently disposed of by means of landfill. Others employ expensive and involved incineration methods to dispose of their sludge whereby the sludge is first dried to form a combustible solid. Because of the rapid increase in the world population over the last 100 years and the shift from an agrarian-based to urban-based culture, the use and/or disposal of increasing quantities of sewage sludge is rapidly becoming a problem of alarming proportion. Furthermore, toxic and hazardous wastes comprise an important component of sludge, adding to the complexity and safety of current sludge disposal techniques since such components are highly leachable. Therefore, it would be extremely advantageous to provide an economic and environmentally acceptable means of disposal of such sewage sludge by use of incineration, thereby avoiding the problems associated with landfills and ocean dumping.

Various methods have been discussed in the patent literature for the disposal of sewage sludge by incineration. For example, U.S. Pat. No. 4,405,332 (issued to Rodriguez et al) discloses a fuel composition comprised of non-dewatered sewage sludge and a particulate solid fuel such as coal. U.S. Pat. No. 4,026,223 (issued to Robbins) discloses a sludge incinerator for use in the flash evaporation of water contained in high moisture sludges. The patent states at column 2, lines 31–33 that "waste oil or other flammable hydrocarbons may be introduced along with the sludge to aid in the ignition of the sludge." U.S. Pat. No. 4,145,188 (issued to Espenscheid et al) discloses a process for the liquefaction of municipal refuse and other solid organic wastes in a highly aromatic refinery petroleum solvent to provide a liquid fuel. U.S. Pat. No. 4,168,670 (issued to Wall et al) discloses the incineration of lime-conditioned dewatered sewage sludge with a high sulfur fuel such as a fuel oil. British Pat. No. 1,198,958 discloses a solid fuel composition comprised of solid sewage waste, coal tip waste and waste oil.

U.S. Pat. No. 3,559,596 (issued to Ishii et al) is directed to a method and apparatus for the incineration of sewage sludge wherein a sludge is subjected to pressure and heated concurrently and then jetted into a combustion chamber. Water contained in the sludge is evaporated instantaneously with the jetting, with the remaining solids being incinerated. The patent discloses at column 2, lines 62–65 that the sludge-feeding duct is connected to a heavy oil-feeding duct. Example 1 also discloses the admixture of heavy oil with a sludge which is comprised of 80 percent by weight of water. The patent appears to be directed to the use of a partially-dewatered sludge as noted in the Examples (water content of 75–80 percent) and column 1, lines 15–20 wherein the partial dewatering of activated and digested sludge is discussed.

Japanese Patent Publication 55-94996 discloses a slurry fuel which includes particulate coal, oil, sewage sludge and a viscosity-lowering additive. The patent states that the sludge may contain from 30 to 90 percent water. However, the patent generally envisions the use of partially dewatered sludge as it states that the sludge should comprise less than 50 percent by weight of water.

Insofar as various of the above-noted methods are not readily adapted to the commercial environment as they require various secondary treatment processes such as dewatering prior to incineration of the fuel, it would be desirable to provide an improved sewage sludge-containing fuel which may be more simply produced and incinerated.

OBJECTS AND SUMMARY OF THE INVENTION

It is therefore an object of the present invention to provide a novel sewage sludge-based combustible fuel.

It is also an object of the present invention to provide a novel combustible fuel comprised of sewage sludge that requires no external fuel source during incineration of the fuel.

It is still yet another object of the present invention to provide a combustible fuel which can be readily adapted, at low cost, for use with existing fuel oil-fired boilers.

It is still another object of the present invention to provide a novel combustible fuel that enhances combustion efficiency and reduces fouling on boiler surfaces.

It is still another object of the present invention to provide an improved method for the disposal of sewage sludge.

It is still further an object of the present invention to overcome the disadvantages of the prior art as discussed above.

In accordance with one aspect of the present invention, there is thus provided an improved fuel composition comprising in minor proportion a non-dewatered sewage sludge and in major proportion an organic fuel comprised of a liquid hydrocarbon fuel oil.

In accordance with another aspect of the present invention, there is provided a method for the incineration of sewage sludge comprising providing an admixture of a minor proportion of a non-dewatered sewage sludge and a major proportion of an organic fuel comprised of a liquid hydrocarbon fuel oil and incinerating the admixture.

More specifically, the fuel composition comprises from about 5 to 25 percent by weight of non-dewatered sewage sludge comprising greater than 90 percent by weight of water and from about 75 to 95 percent by weight of an organic fuel comprised of a hydrocarbon fuel oil.

DETAILED DESCRIPTION OF THE INVENTION

Figure 1:
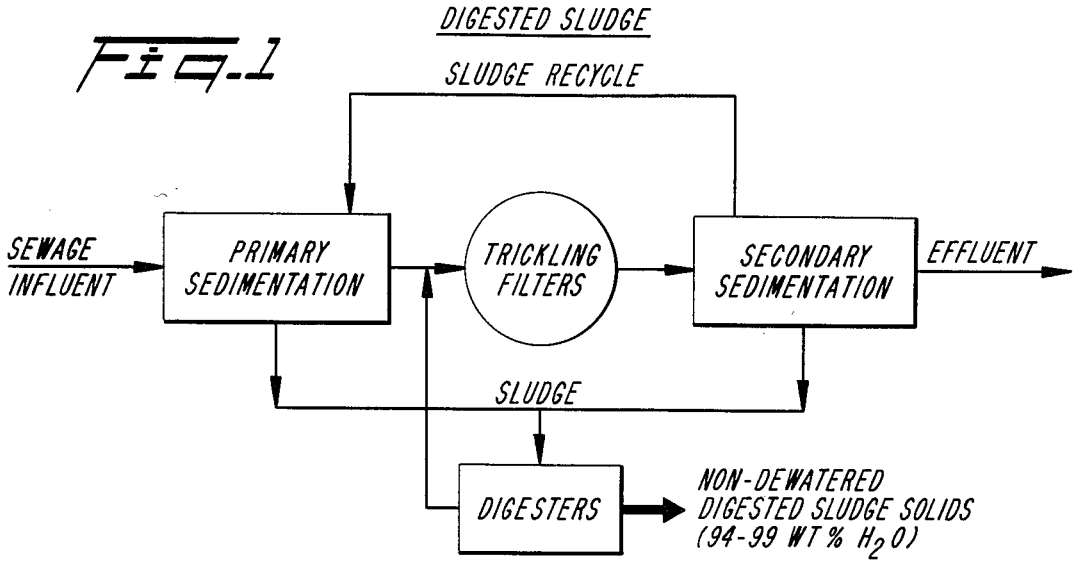
FIGS. 1–3 depict schematically various conventional methods for the treatment of raw sewage, the thus-produced sludge solids of which may be employed as the non-dewatered sewage sludge portion of the fuel composition of the present invention.

It has been surprisingly and unexpectedly found that an admixture comprised of non-dewatered sewage sludge and an organic fuel such as a liquid hydrocarbon fuel oil is well suited for use as a combustible fuel.

The combustible fuel composition of the present invention provides many advantages. For instance, sewage sludge is generally readily available and the use thereof in such a composition enables disposal problems to be simplified by avoiding the use of landfills and expensive and involved incineration and/or purification processes. In addition, the utilization of a fuel composition that contains a minor proportion of non-dewatered sewage sludge dispersed throughout a major proportion of fuel oil provides a fuel that burns with increased efficiency compared to the combustion of fuel oil alone. The use of the fuel composition of the present invention results in more complete combustion (evidenced by reduced soot formation) than exists with the combustion of fuel oil alone. Further, the aqueous component upon vaporization provides for additional radiant energy release from the flame due to the water molecules serving as a good emitter/absorber of radiant energy. As a result of these features, less air is required for complete combustion, providing for increased efficiency which more than offsets whatever fuel penalty may be incurred as a result of the vaporization of the water in the sewage sludge component during combustion. Additional sources of combustible materials are also provided in the form of combustible solids present in the sewage sludge which further compensates for the heat of vaporization disadvantageously withdrawn from the combustion process by the vaporization of water. As a result of the added radiant energy release and more efficient burn, less boiler fouling results from combustion of the sewage sludge-fuel oil admixture of the present invention compared to the combustion of fuel oil alone.

Furthermore, as a result of the temperatures and residence times normally encountered in oil-fired boilers, the use of the sewage sludge/fuel oil admixture of the present invention in such boilers will result in the complete destruction of hazardous or undesirable organic materials within the sludge. Pathogens, viruses, bacteria, polychlorinated biphenyls, etc. which may be present in the sludge will thus be combusted and destroyed, with the flue gases realizing a 3–4 second residence time at a temperature envelope ranging from approximately 3500° F. or greater at the flame to approximately 2200° F. or greater at the furnace exit.

The combustible organic fuel employed in the present invention may be comprised of any suitable liquid hydrocarbon fuel oil. The fuel oil typically comprises a major portion of the sewage sludge/fuel admixture, such as from about 75 to 95 percent by weight, and preferably comprises from about 85 to 90 percent by weight of the sewage sludge/fuel admixture.

The liquid hydrocarbon fuel which is employed can comprise fuel oils of various grades (e.g., Nos. 1, 2, 3, 4, 5 or 6 fuel oils or mixtures thereof), resids, crude oils, coke oven tars, shale oil, bitumen or other suitable liquid hydrocarbon fuels. The preferred fuel oil component comprises Nos. 4, 5 and 6 fuel oil. The above listing is not intended to be all inclusive and one skilled in the art can readily determine which types of fuel oils can be employed as the fuel oil component of the present invention.

The sewage sludge component of the fuel admixture of the present invention typically comprises a minor proportion of the admixture, such as from about 5 to 25 percent by weight and preferably comprises from about 10 to 15 percent by weight of the fuel admixture. Such sewage sludge comprises, in essence, sludge which has not been dewatered to any significant extent. A non-dewatered sludge for purposes of the present invention is intended to refer to a sludge which contains greater than 90 percent by weight of water and comprises up to about 99.5 percent by weight of water. Preferably, the sewage sludge comprises from about 92 to 99.5 percent by weight of water, and most preferably from about 95 to 99.5 percent by weight of water. The remainder of the sludge comprises combustible (volatile matter) and non-combustible (ash) solids in total amounts ranging from about 0.5 to less than 10 percent by weight.

Sewage sludge is by definition the mixture of sewage (i.e., contaminated water) and settled solids. As a result of the type of treatment received, it may be designated as raw or fresh, digested, activated, dewatered or dried. Other descriptive terms include elutriated, Imhoff and septic tank sludge.

Figure 2:
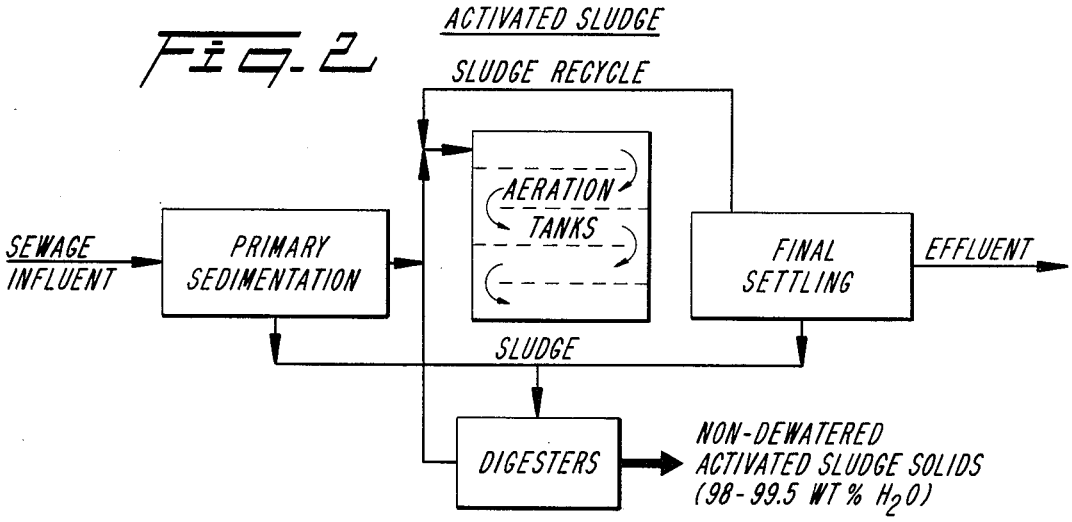
Figure 3:
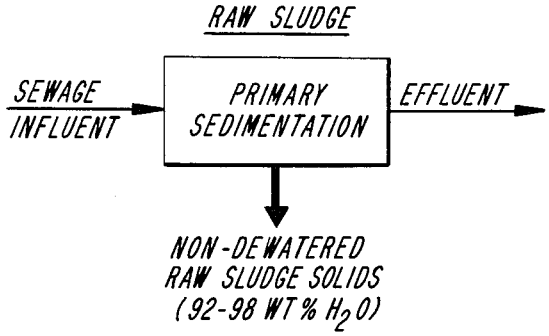

The present invention concerns the utilization of non-dewatered sludge. Therefore, the sludge to be admixed with the solid fuel would, in most cases, be raw, digested, or activated sludge which include the requisite amount of water. However, there may be situations where it could be efficacious to admix water with dewatered or dried sludge in order to dispose of the sludge (in a "non-dewatered" form) by the method of the present invention. Typical flow diagrams depicting conventional methods for the production of raw (92–98 wt. percent water), digested (94–99 wt. percent water), or activated (98–99.5 wt. percent water) sludge solids are shown in FIGS. 1, 2 and 3, respectively.

Raw sludge solids are produced by plain sedimentation. Digested and activated sludge solids are produced by the secondary treatment of sewage. The digested and activated sludge treatment processes each depend upon aerobic biological organisms to effect decomposition, with the only difference between the two processes being the method of operation. Digested sludge treatment employs trickling filters wherein the organisms attach themselves to the filters and the organic material (sewage) is pumped through the organisms for the digestion process. In the activated sludge treatment process, the organisms are migrant and are thoroughly admixed with the organic matter to effect digestion.

The quantity and composition of sludge varies with the character of the sewage from which it is removed. It also is dependent on the type of treatment that it receives. Typical concentrations and analyses of the solids for various non-dewatered sewage sludges are shown in Table 1 below:

TABLE 1

CONCENTRATION AND ANALYSIS OF VARIOUS TYPES OF NON-DEWATERED SLUDGE SOLIDS

| CONSTITUENT, WT % | RAW | DI-GESTED | ACTIVATED |
|---|---|---|---|
| Solids, Total | 2-8 | 1-6 | 0.5-2 |
| Solids, Dry Basis: | | | |
| Volatile Matter | 55-80 | 40-60 | 62-75 |
| Ash | 20-24 | 40-60 | 25-38 |
| Insoluble Ash | 15-35 | 30-50 | 22-30 |
| Grease and Fats | 5-35 | 2-17 | 5-12 |
| Protein | 20-28 | 14-30 | 32-41 |
| Ammonium Nitrate | 1-3.5 | 1-4 | 4-7 |
| Phosphoric Acid | 1-1.5 | 0.5-3.7 | 3-4 |
| Potash | | 0-4 | 0.86 |
| Cellulose | 8-13 | 8-13 | 7.8 |
| Silica | | 15-16 | 8.5 |
| Iron | | 5.4 | 7.1 |

Gross Heating Value, 7250 Btu/Lb (dry basis)

Trace metal constituents in sewage sludge solids vary widely depending on the proportion of domestic and industrial quantities that make up the composite. An analysis of trace inorganic constituents (>2 ppm by weight) for a typical municipal sewage sludge ash is shown in Table 2:

TABLE 2

SEWAGE SOLIDS ASH TRACE INORGANIC CONSTITUENTS (Concentration in ppm Weight)

| Element | Concentration | Element | Concentration |
|---|---|---|---|
| Uranium | 7 | Yttrium | 16 |
| Thorium | 8 | Strontium | 140 |
| Bismuth | 7 | Rubidium | 7 |
| Lead | 150 | Selenium | 6 |
| Mercury | 4 | Arsenic | 10 |
| Tungsten | 4 | Germanium | 2 |
| Samarium | 4 | Gallium | 16 |
| Neodymium | 5 | Copper | 260 |
| Praseodymium | 5 | Nickel | 8 |
| Cerium | 49 | Cobalt | 4 |
| Lanthanum | 49 | Manganese | 640 |
| Barium | 900 | Chromium | 220 |
| Antimony | 7 | Vanadium | 36 |
| Tin | 77 | Scandium | 11 |
| Cadmium | 3 | Chlorine | 47 |
| Silver | 35 | Fluorine | 670 |
| Molybdenum | 5 | Boron | 8 |
| Niobium | 24 | Lithium | 12 |
| Zirconium | 70 | | |

Depending on the sewage sludge solids ash content and analysis and also the location of the incineration facility (i.e., utility, industrial or municipal boiler) an electrostatic precipitator, bag house, etc., may or may not be required to meet federal and/or state regulations concerning particulate emissions upon incineration of the fuel composition of the present invention.

Figure 4:
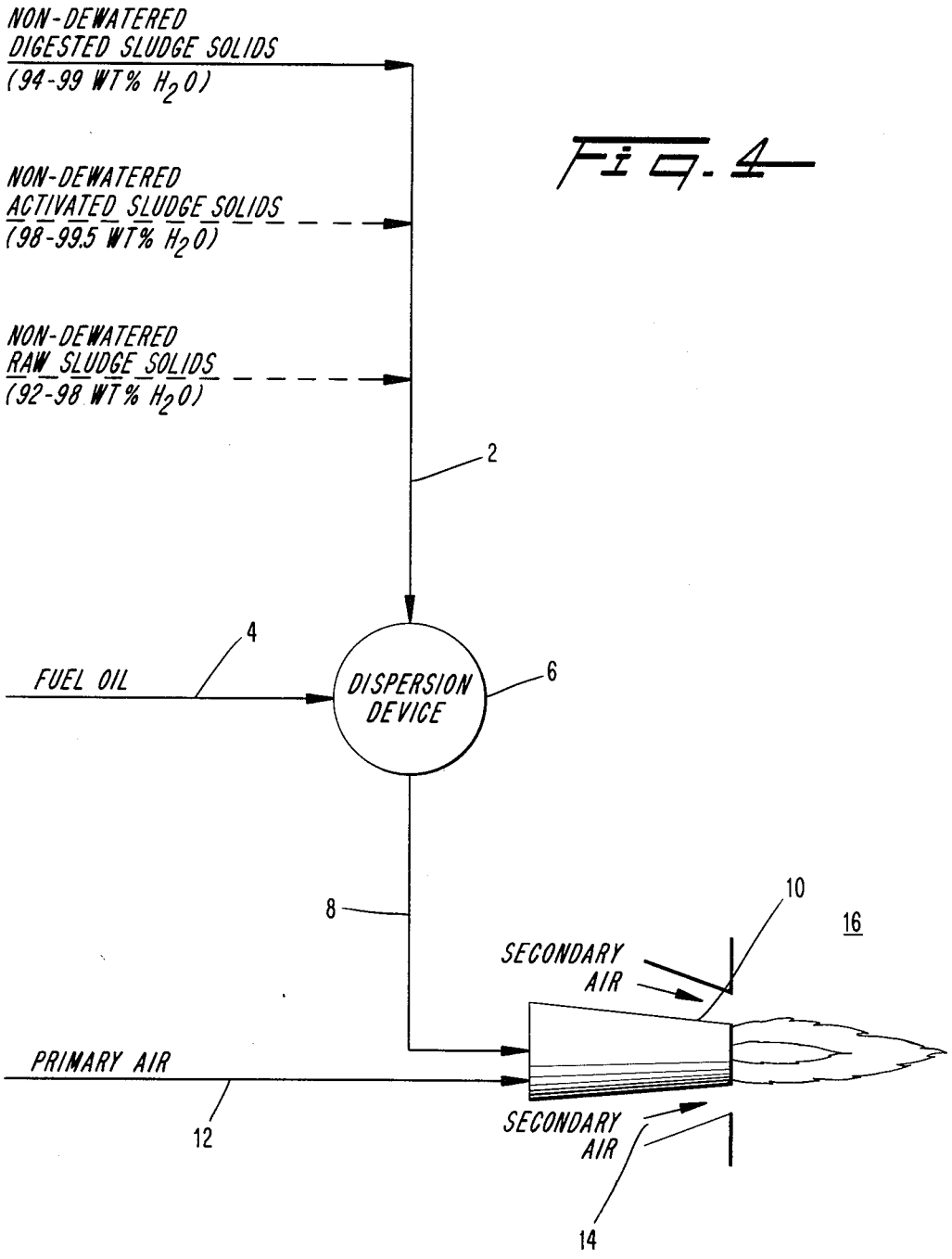
FIG. 4 depicts schematically a suitable means of dispersing sewage sludge throughout a liquid hydrocarbon fuel oil with subsequent incineration of the fuel admixture in accordance with the method of the present invention.

The combustible fuel admixture of the present invention may be formed as shown in FIG. 4 by admixing the non-dewatered sewage sludge component 2 with the organic fuel component 4 (i.e., fuel oil) in suitable proportions. The respective components are desirably admixed thoroughly by a suitable means 6 known to those skilled in the art in order to disperse the sewage sludge throughout the fuel oil. This may be accomplished through an in-line dispersion means such as a venturi mixer, ultrasonic mixer or combination thereof. The fuel admixture 8 is then passed to burner 10 together with primary air 12 and secondary air 14 to provide heat to boiler 16. While the size of suspended particles in sewage sludge normally ranges from 5 to 10 microns, with agglomerated particles ranging from 100 to 500 microns, such solids are readily dispersed within the fuel composition.

A further advantage of the more complete combustion accomplished by means of the present invention is that reduction of excess air is possible. With the reduction of excess air, lower quantities of nitrogen oxides should be produced compared to conventional oil firing. Although the need for excess combustion air is reduced, the flame temperature is not increased accordingly due to the water addition with the sludge. Therefore, a reduction of thermal nitrogen oxide ($NO_x$) results, thermal $NO_x$ production being dependent on the flame temperature and the quantity of oxygen available during combustion.

Table 3 shows a fuel comparison between a No. 4-5 fuel oil and a No. 4-5 fuel oil/sewage sludge fuel admixture of the present invention wherein the sludge comprises about 95 percent by weight of water. Table 4 compares flue gas compositions and flame temperatures resulting from incineration of the respective fuels:

TABLE 3

FUEL COMPARISON

| | 0.3 WT % Sulfur #4-5 FUEL OIL | OIL/SLUDGE 85/15 |
|---|---|---|
| FUEL | | |
| Analysis, wt % | | |
| C | 87.33 | 74.48 |
| H | 11.69 | 9.98 |
| O | 0.30 | 0.38 |
| N | 0.25 | 0.24 |
| S | 0.30 | 0.26 |
| ASH | 0.03 | 0.33 |
| $H_2O$ | 0.10 | 14.33 |
| TOTAL | 100.00 | 100.00 |
| HHV, Btu/Lb | 18,500 | 15,425 |
| Air Required, SCF(1)/MM Btu (HHV) | | |
| W/6 vol % Excess | 10,530 | 10,765 |
| W/15 vol % Excess | 11,425 | 11,680 |
| % Increase Over Fuel Oil | | |
| W/6 vol % Excess | — | 2.25 |
| W/15 vol % Excess | — | 2.23 |

(1)SCF, standard cubic feet @ 60 degrees F. and 14.7 psia.

TABLE 4

FLUE GAS COMPARISON

| | 0.3 wt % S #4-5 Fuel Oil | | 85/15 Oil/Sludge | |
|---|---|---|---|---|
| | Excess Air 6 Vol % | Excess Air 15 Vol % | Excess Air 6 Vol % | Excess Air 15 Vol % |
| Composition, Vol % | | | | |
| $CO_2$ | 13.40 | 12.40 | 13.18 | 12.21 |
| $H_2O$ | 10.70 | 9.90 | 12.20 | 11.31 |
| $SO_2$ | 0.02 | 0.02 | 0.02 | 0.02 |
| $N_2$ | 74.76 | 75.08 | 73.49 | 73.90 |
| $O_2$ | 1.12 | 2.60 | 1.11 | 2.56 |
| TOTAL | 100.00 | 100.00 | 100.00 | 100.00 |
| Ave. Mol. Wt. | 29.14 | 29.12 | 28.96 | 28.95 |
| SCF/MMBtu (HHV)(1) | 11,130 | 12,025 | 11,580 | 12,490 |
| % Increase over fuel oil | — | — | 4.0 | 3.9 |
| Flame Temp., °F.(2) | 3,965 | 3,755 | 3,790 | 3,595 |
| % Decrease from Fuel Oil | — | — | 175 | 160 |

(1)SCF, standard cubic feet @ 60 degrees F. and 14.7 psia.
(2)Calculated adiabatic flame temperature assuming combustion air @ 600 degrees F. and excluding dissociation and radiation losses.

The comparison in Tables 3 and 4 shows the effect of the use of both 6 and 15 volume percent excess air on the fuel combustion. An increase of flue gas produced during combustion of the oil/sludge is shown in comparison to the combustion of oil along together with a decrease in flame temperature. However, due to the enhanced combustion rate and efficiency of oil/sludge combustion compared to the combustion of oil, excess air requirements for the oil/sludge fuel may be reduced to less than that for oil. For example, if 10 percent excess air is required for the complete combustion of oil, only 8 percent excess air may be required for complete combustion of the oil/sludge fuel. It is this feature of the oil/sludge combustion that permits evaporation and the heating of the water component in the sludge with no resultant increase in energy requirement in comparison to fuel oil combustion.

The combustible fuel admixture of the present invention can be utilized as a fuel source for a variety of applications such as boilers which are employed in the generation of steam for industrial use or electric power generation. The fuel can be directly substituted for conventional fuel oils without modification of the incineration means. The sewage sludge is incinerated substantially completely during the combustion process which enables the combustion of the fuel admixture to serve as a viable disposal method for sewage sludge without the need for elaborate sludge treatment steps.

Various modifications of the fuel composition of the present invention are within the skill of the routineer in the art. For example, while unnecessary, the organic fuel component may comprise in addition to the liquid hydrocarbon fuel combustible solid organic fuels such as coal, coke (e.g., petroleum or by-product coke), peat, wood, humate or charcoal. The combustible solid organic fuel particles would, if present, be employed in an amount ranging from about 40 to about 80 percent by weight, based on the total weight of the liquid and solid organic fuels. The percentage of solid organic fuel particles employed and the percentage of the organic fuel component present in the total mixture must be correlated such that the solid organic fuel is present in the total mixture in an amount ranging from about 40 to 60 percent by weight. Such combustible solids would also preferably be of a size ranging from about 100% minus 8 mesh to about 100% minus 325 mesh.

It should be noted that the fuel oil constitutes an essential component of the organic fuel fraction, with the combustible solids being added only in the event that it is desirable to reduce the amount of fuel oil employed (e.g., for economic reasons). The fuel oil thus at a minimum comprises about 20 percent by weight of the organic fuel, generally comprising from about 20 to 60 percent of the organic fuel (if combustible solids are present) and from about 15 to 55 percent by weight of the total weight of the fuel composition (if combustible solids are present). Preferably, however, the fuel composition consists essentially of the sewage sludge component and a liquid hydrocarbon fuel oil without the noted combustible solids.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An improved fuel composition comprising from about 5 to 25 percent by weight of non-dewatered sewage sludge comprising from about 92 to 99.5 percent by weight of water with the remainder comprising solids and from about 75 to 95 percent by weight of an organic fuel comprised of a fuel oil.

2. The fuel composition of claim 1 wherein said fuel oil is selected from the group consisting of Nos. 1, 2, 3, 4, 5, 6 grade fuel oil and mixtures thereof, petroleum residuum, crude oil, shale oil, coke oven tars and bitumen.

3. The fuel composition of claim 1 wherein said organic fuel further comprises a combustible solid selected from the group consisting of coal, petroleum coke, by-product coke, charcoal, humate, peat, wood and mixtures thereof.

4. The fuel composition of claim 3 wherein said combustible solid is present in an amount ranging from about 40 to 60 percent by weight based on the weight of the fuel composition and said fuel oil is present in an amount ranging from about 15 to 55 percent by weight based on the weight of the fuel composition.

5. The fuel composition of claim 1 consisting essentially of non-dewatered sewage sludge and said hydrocarbon fuel oil.

6. The fuel composition of claim 1 wherein said fuel oil is selected from the group consisting of Nos. 4, 5 or 6 grade fuel oil and petroleum residuum.

7. The fuel composition of claim 1 comprising from about 10 to 15 percent by weight of said sewage sludge and from about 85 to 90 percent by weight of said fuel oil.

8. A method for the incineration of sewage sludge comprising providing a fuel composition comprised of from about 5 to 25 percent by weight of a non-dewatered sewage sludge comprising from about 92 to 99.5 percent by weight of water with the remainder comprising solids and from about 75 to 95 percent by weight of an organic fuel comprised of a fuel oil and incinerating the composition.

9. The method of claim 8 wherein said fuel oil is selected from the group consisting of Nos. 1, 2, 3, 4, 5, 6 grade fuel oil and mixtures thereof, petroleum residuum, crude oil, shale oil, coke oven tars and bitumen.

10. The method of claim 8 wherein said organic fuel further comprises a combustible solid selected from the group consisting of coal, petroleum coke, by-product coke, charcoal, humate, peat, wood and mixtures thereof.

11. The method of claim 10 wherein said combustible solid is present in an amount ranging from about 40 to 60 percent by weight based on the weight of the fuel composition and said fuel oil is present in an amount ranging from about 15 to 55 percent by weight based on the weight of the fuel composition.

12. The method of claim 8 wherein said fuel composition consists essentially of non-dewatered sewage sludge and said hydrocarbon fuel oil.

13. The method of claim 8 wherein said fuel oil is selected from the group consisting of Nos. 4, 5 or 6 grade fuel oil and petroleum residuum.

14. The method of claim 8 wherein said fuel composition comprises from about 10 to 15 percent by weight of said sewage sludge and from about 85 to 90 percent by weight of said fuel oil.

* * * * *